US005188072A

United States Patent [19]

Nolte et al.

[11] Patent Number: 5,188,072

[45] Date of Patent: Feb. 23, 1993

[54] FUEL PUMP DESIGNED AS ROTOR PUMP

[75] Inventors: Albert Nolte; Joachim Altdorf; Paul Scheffler, all of Cologne, Fed. Rep. of Germany

[73] Assignee: Kloeckner-Humboldt-Deutz AG, Cologne, Fed. Rep. of Germany

[21] Appl. No.: 544,658

[22] Filed: Jun. 27, 1990

[30] Foreign Application Priority Data

Jun. 29, 1989 [DE] Fed. Rep. of Germany ..... 3921245

[51] Int. Cl.[5] ..... F02B 77/00; F01C 1/10

[52] U.S. Cl. ..... 123/198 C; 123/198 R; 418/171

[58] Field of Search ..... 123/509, 198 C, 508; 418/166, 171

[56] References Cited

U.S. PATENT DOCUMENTS

| | | | |
|---|---|---|---|
| 2,240,056 | 4/1941 | Schmitz | 418/166 |
| 3,407,741 | 10/1968 | Weber et al. | 418/166 |
| 3,427,983 | 2/1969 | Brundage | 418/171 |
| 3,536,426 | 10/1970 | Albrecht et al. | 418/166 |
| 3,643,642 | 2/1972 | Junes | 123/198C |
| 3,730,147 | 5/1973 | Buchwald | 123/198 R |
| 4,054,108 | 10/1977 | Gill | 123/198 C |
| 4,127,364 | 11/1978 | Eiermann et al. | 418/171 |
| 4,185,717 | 1/1980 | Ford, Jr. et al. | 418/171 |
| 4,540,347 | 9/1985 | Child | 418/171 |
| 4,629,399 | 12/1986 | Friebe | 418/171 |
| 4,662,320 | 5/1987 | Moriya | 123/198 C |
| 4,827,881 | 5/1989 | Baker et al. | 123/196 R |
| 4,922,781 | 5/1990 | Peiji | 418/171 |
| 4,968,233 | 11/1990 | Nakayoshi | 418/171 |
| 4,969,806 | 11/1990 | Nusser | 418/171 |
| 4,976,595 | 12/1990 | Taniguchi | 418/171 |

FOREIGN PATENT DOCUMENTS

| | | | |
|---|---|---|---|
| 0070014 | 4/1983 | Japan | 184/6.5 |
| 2140083 | 11/1984 | United Kingdom | 123/508 |

*Primary Examiner*—E. Rollins Cross
*Assistant Examiner*—Thomas N. Moulis
*Attorney, Agent, or Firm*—Charles L. Schwab

[57] ABSTRACT

The fuel pump permits a high delivery pressure with a low degree of pressure fluctuations and can be attached to the internal-combustion engine in a space-saving manner in axial prolongation of the camshaft and can be driven in a simple fashion. In an alternative embodiment of the invention, the fuel pump serves as a tensioning device for a belt or chain drive by virtue of the drive wheel of the fuel pump acting as a belt or chain tensioning roller.

6 Claims, 3 Drawing Sheets

FUEL PUMP DESIGNED AS ROTOR PUMP

TECHNICAL FIELD

This invention relates to a rotary fuel pump for an internal-combustion engine.

PRIOR ART STATEMENT

It is known to design fuel pumps as diaphragm pumps. In these pumps, the fuel delivery pressure is restricted to approx. 0.8 bar on account of the diaphragm life. Furthermore, the fuel delivery pressure fluctuates very widely, since no fuel is delivered during each suction stroke of diaphragm pumps so that the pressure drops to zero. In other known plunger pumps, likewise, the fuel delivery pressure collapses during the suction stroke so that the fuel delivery pressure pulsates in these pumps as well. If double-action plunger pumps are employed, the structural cost becomes very high. Diaphragm pumps and plunger pumps are generally driven by cams on the camshaft via drag levers. In addition, there is no room for this cam in the case of camshafts having more than two cams per cylinder.

OBJECTS AND SUMMARY OF THE INVENTION

It is the object of the invention to create a fuel pump that reliably delivers with a high average fuel delivery pressure and small pressure fluctuations and simultaneously can be manufactured at low cost.

In accordance with the invention, this object is achieved by virtue of the fact that the fuel pump is designed as a rotor pump that exhibits an inner gear and an outer gear. It is no problem to attain high delivery pressures with such rotor pumps, the pressure fluctuations of the delivered fuel being small. Furthermore, such rotor pumps are very compact in structure and can be manufactured at low cost.

In development of the invention, the rotor pump is arranged in axial prolongation of a camshaft and is driven by said camshaft. By means of the compact structural form of the rotor pump, a space-saving arrangement on the internal-combustion engine is thus achieved, there being, furthermore, no problems in driving the rotor pump in the case of internal-combustion engines having more than two cams per cylinder.

In development of the invention, the rotor pump shaft is mounted in a central recess in the camshaft and in a journal bearing arranged in the rotor pump case. This embodiment simplifies the rotor pump, since only one additional bearing is required, while the recess in the camshaft is easy to fabricate. The torsionally rigid connection of the rotor pump shaft with the camshaft is accomplished by means of a drive slot adjacent to the recess in the camshaft, in which slot a corresponding drive tongue of the rotor pump shaft engages. Alternatively, it is also provided in accordance with the invention to give the recess a wedge profile over, at least over part of its axial length, which wedge profile cooperates with a corresponding wedge profile on the rotor pump shaft. Naturally, it is also possible to implement the torsionally rigid connection by means of other suitable means, such as, for example, by means of a tongue-and-groove connection.

In development of the invention, the inner gear and the outer gear are arranged in a pump space that is placed at the end of the rotor pump case away from the camshaft and wherein the pump space is closable in a fluid-tight manner by a cover. This arrangement contributes to a simple design of the rotor pump, since by means of this terminal arrangement of the pump space it is possible to dispense with a division and precise orientation of the parts of the rotor pump case, the pump working space being closable by means of a simple cover, instead. Thus all the problems that are otherwise necessary in the requisite orientation of the case parts are eliminated.

In the development of the invention, between the recess in the camshaft and the journal bearing at least one seal ring is arranged between the rotor pump shaft and the rotor pump case. Thus, lubricating oil from the lubricating oil loop of the internal-combustion engine is prevented from mixing with the fuel.

In development of the invention, an oil seal and a fuel seal ring are provided, the oil seal ring being on the side toward the camshaft and the fuel seal ring being on the side toward the pump space. This arrangement insures an especially reliable sealing, since commercial seal rings can be employed, which rings are turned with one sealing side facing toward each of the respective fluid spaces to sealed. Here, in development of the invention, between the oil seal ring and the fuel seal ring an intermediate space is provided, which is vented to the environment via a duct. In this manner, excessive pressure is prevented from building up between the seal rings and mixing of the two media (oil and fuel) is prevented from occurring.

In an alternative embodiment of the invention, the rotor pump is connected to a driving shaft, for example the crankshaft of the internal-combustion machine, via a belt or chain drive so that the driving of the rotor pump takes place via said belt or chain drive. By means of this arrangement, the rotor pump is mounted in a space-saving manner and there is no need for additional driving of the rotor pump.

In development of the invention, the rotor pump is designed as a tensioning device for the belt or chain drive. For this purpose, the rotor pump shaft is connected to a drive wheel, said drive wheel simultaneously functioning as a belt or chain tensioning roller. With this belt tensioning roller or this chain tensioning roller, a drive belt or a chain can be tensioned in the conventional manner, it being possible for the drive belt or the chain to be connected to other motor components such as, for example, an oil pump or a fan for a cooling fan. Furthermore, an otherwise revolving tensioning wheel, by means of which energy would needlessly consumed, becomes unnecessary.

The case of the rotor pump is connected to a tensioning lever that rests against the housing of the internal-combustion engine. In this way, by a slight sliding or pivoting of the case of the rotor pump, it is possible, without great effort, to alter the position of the tensioning wheel, i.e., the position of the drive wheel of the rotor pump, and to adjust the tension of the belt drive or chain drive. Furthermore, by means of the previously described arrangement of the rotor pump in accordance with the invention, the rotor pump is no longer driven after a rupturing, breaking or jumping off of the belt or of the chain so that an immediate interruption of the fuel supply takes place, by which means the internal-combustion engine is stopped. No damage can occur to the internal-combustion engine, for example due to overheating because of a cooling fan that has stopped running or a water pump that has come to a stop, which fan or water pump is driven via the belt drive or chain drive. The rotor pump thus represents a safety shutdown device for the internal-combustion engine. For this reason, also, expensive monitoring means for the condition of the belt or chain drive become unnecessary.

In development of the invention, the drive wheel of the rotor pump exhibits a revolving recess, which is located between the hub and the belt or chain contact surface of said drive wheel. Due to this recess, when the drive wheel is mounted on the rotor pump shaft, a projecting part of the rotor pump case is covered by the drive wheel and there remains only a small gap between the inner part of the drive wheel and the projecting part of the rotor pump case so that no contaminants can reach the bearing of the rotor pump shaft. By means of this design, it is likewise possible to place a bearing of the rotor pump shaft (e.g., ball bearing) in the plane of the drive wheel so that the dimensions of the rotor pump case can be kept compact.

BRIEF DESCRIPTION OF THE DRAWINGS

Further embodiments in accordance with the invention can be understood from the description of the drawing. The individual figures show the following.

DETAILED DESCRIPTION OF THE DRAWINGS

Figure 1:
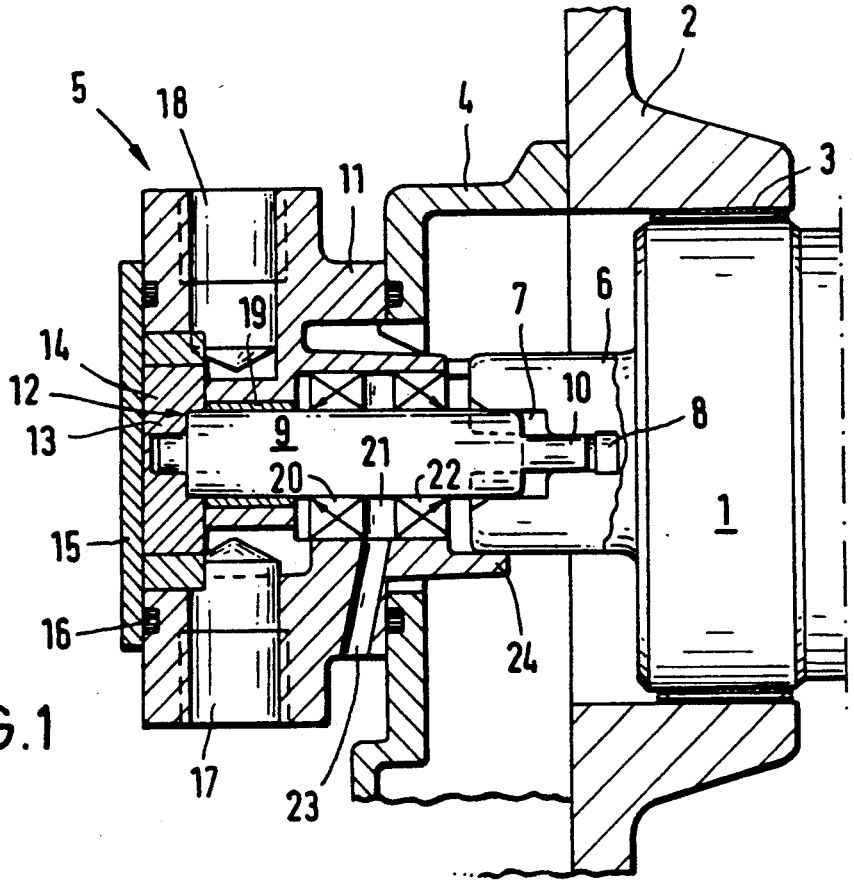
FIG. 1 shows a fuel pump in accordance with the invention, which is mounted in axial prolongation of the camshaft.

In FIG. 1, a camshaft 1 is supported in a housing 2 of an internal-combustion engine via a terminal camshaft bearing 3. Attached to the housing 2 is a housing cover 4, in which there is made an opening, in axial prolongation of the camshaft 1, which opening exhibits a smaller diameter than the camshaft bearing 3. Attached to the housing cover 4, in turn, is a fuel pump 5, which is designed as a rotor pump and is attached in a suitable manner to the housing cover 4 in axial prolongation of the camshaft 1.

The camshaft 1 exhibits an axial projection 6, extending into the housing cover 4, which projection exhibits a central recess 7 and, adjacent thereto in the direction toward the camshaft bearing 3, a drive slot 8. The diameter of the central recess 7 is sized such that the end portion of a rotor pump shaft 9 is insertable thereinto and makes an exact fit. This end portion of the rotor pump shaft 9 exhibits a drive tongue 10, which in turn exactly engages in the drive slot 8. In the rotor pump case 11, on the side facing away from the camshaft 1, there is a pump space 12, which is occupied by an inner gear 13 and an outer gear 14. The inner gear is likewise connected in a torsionally rigid manner to the rotor pump shaft via a drive slot into which a further drive tongue of the rotor pump shaft engages. The pump space 12 is closed by a cover 15, which is attached to the rotor pump case 11 with a seal 16 inserted therebetween. The pump space 12 is provided with a suction port 17 and a pressure port 18, which are connected in a suitable fashion to a fuel tank and a mixture-forming means such as a carburetor, or to an injection means, for example for a diesel engine.

Connected to the pump space 12, on the side toward the camshaft 1, is a journal bearing 19, which forms the only support point of the rotor pump in the rotor pump case 11. Further, connected to the journal bearing 19 is a fuel seal ring 20, an intermediate space 21, and an oil seal ring 22. The intermediate space 21 is connected to the environment via a duct 23 at a geodetically lower point.

Since the fuel pump 5 exhibits only one journal bearing 19, exact orientation of the rotor pump shaft 9 in axial prolongation of the camshaft 1 must be insured. This is done by means of three lugs 24 in which the rotor pump case 11 terminates on the camshaft side. The lugs 24 surround the projection 6, are distributed about the periphery, and center the rotor pump shaft 9 with respect to the camshaft 1. As the rotor pump case 11 is made of a softer material than the camshaft, after a few revolutions enough lug material is ground away at the contact point lugs 24 and projection 6 that noise-free running of the fuel pump 5 is insured.

With respect to the functioning of the rotor pump (Eaton pump), known per se, it can be said that the outer gear 14 is made to bear on the inner gear 13 at one side so that a sickle-shaped working space is formed at the opposite side. In the motion of the gears 13 and 14, the pump spaces are continuously enlarged on the suction side, while the process goes in the opposite direction on the pressure side.

Figure 3:
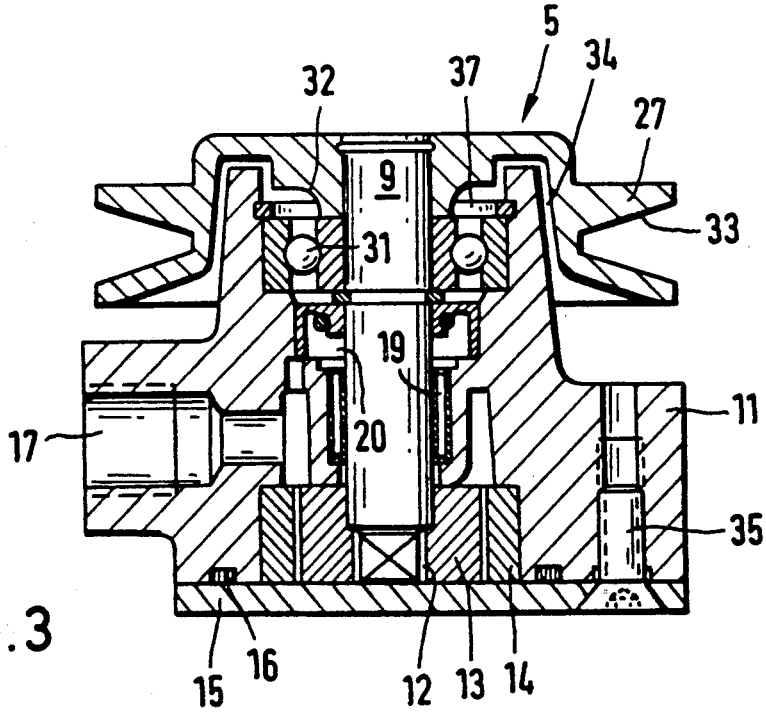
FIG. 3 shows the fuel pump from FIG. 2 in enlarged, cutaway view.
Figure 2:
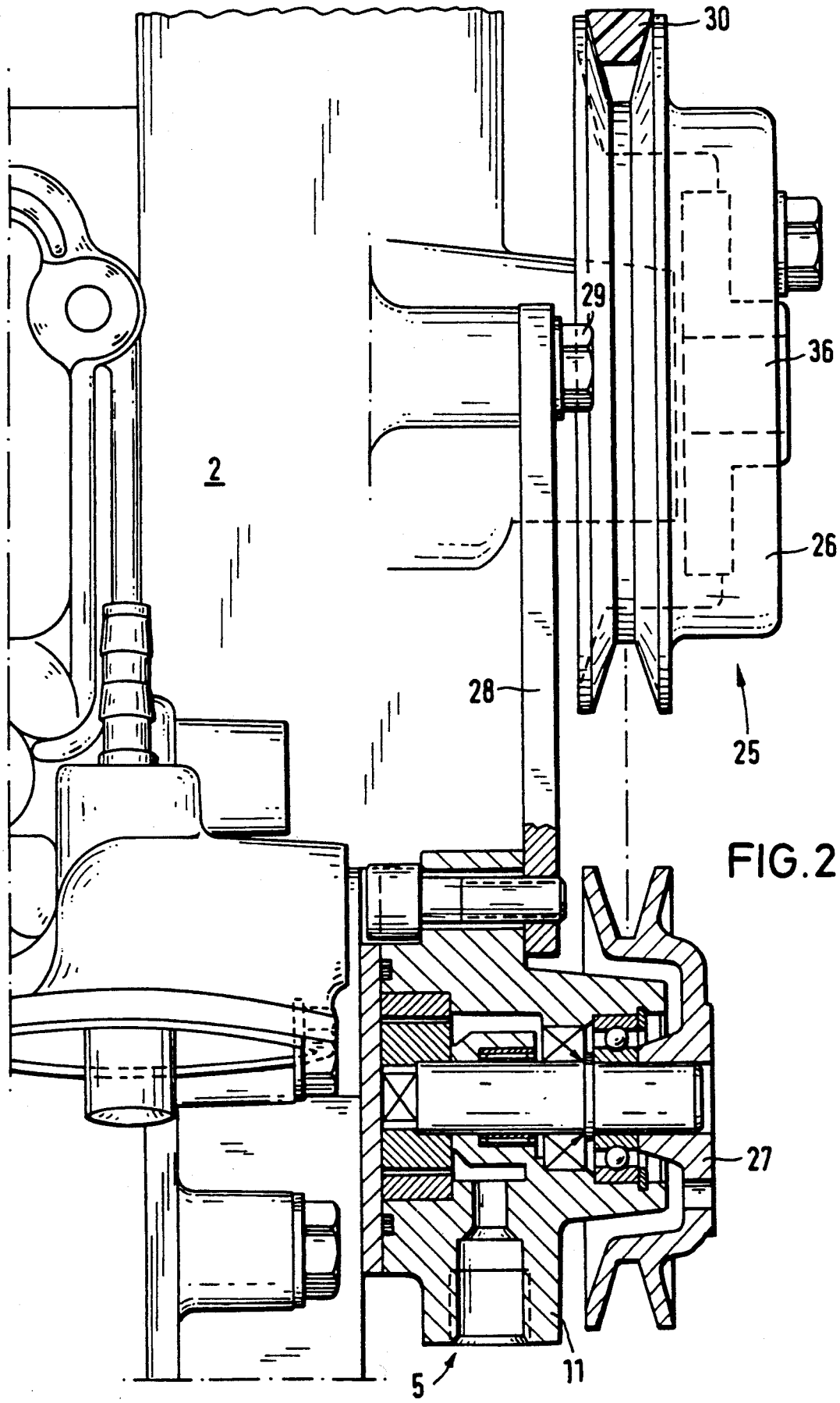
FIG. 2 shows the belt drive of an internal-combustion engine, which, starting from a driving shaft of the motor, drives the drive wheel of a fuel pump.
Figure 4:
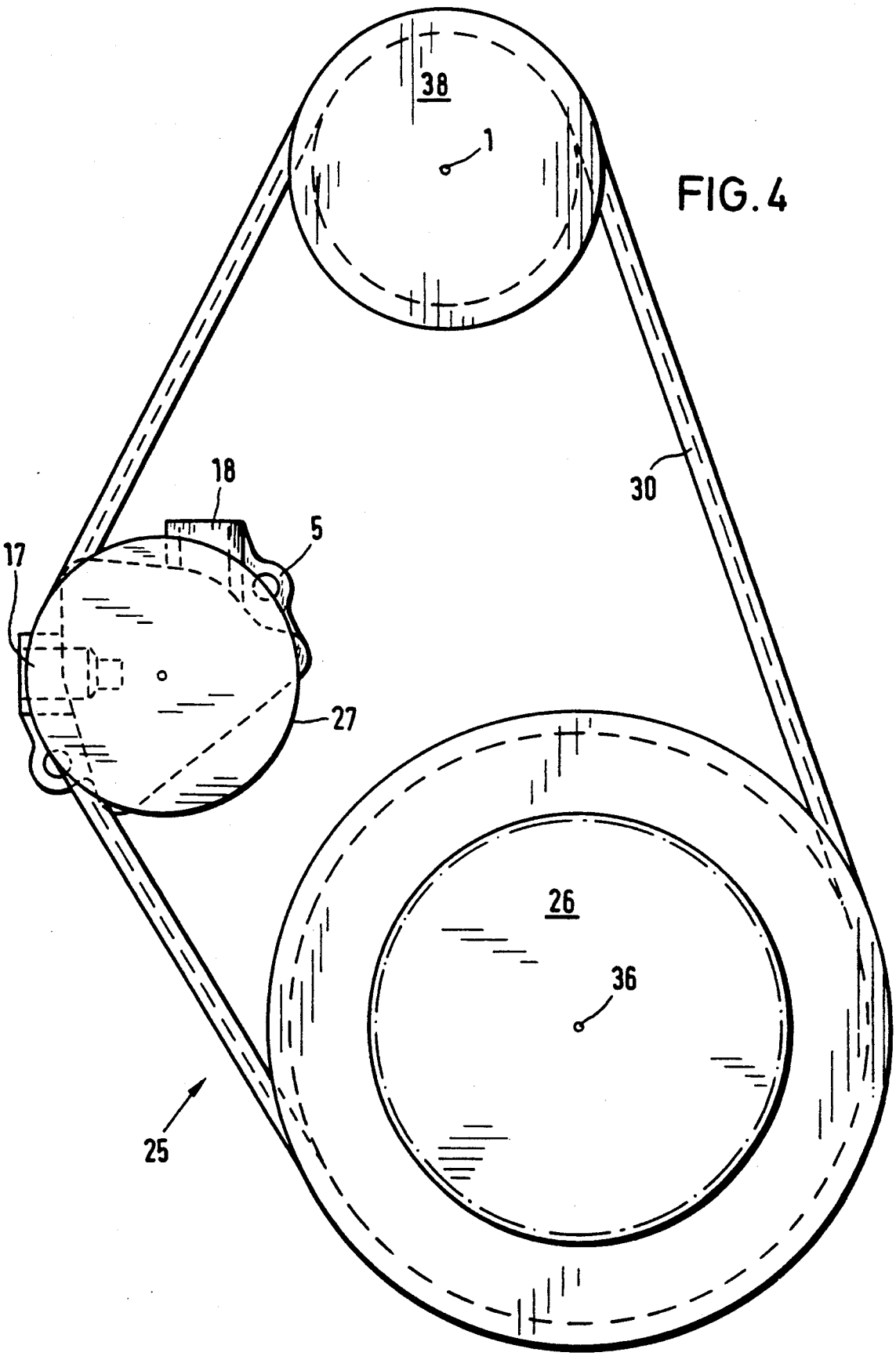
FIG. 4 shows the belt drive of an internal-combustion engine, which, starting from a driving shaft, drives the camshaft and is tensioned by the drive wheel of the fuel pump.

The components described in FIG. 1, insofar as they are present in FIGS. 2, 3 and 4, are labeled with the same reference numbers. In addition to the components already described, further details of the alternative embodiment of the rotor pump are explained below.

In FIG. 2, a belt drive 25 is illustrated in front of the outlines of the housing 2 of an internal-combustion engine. Starting from the driving wheel 26 of the driving shaft 36, a crankshaft of the internal-combustion engine, the fuel pump 5 is driven via a drive pulley which includes a drive wheel 27 designed as a tensioning wheel.

The rotor pump case 11 of the fuel pump is mounted on one end of the tensioning lever 28. The tensioning lever 28 is provided with a recess (e.g., a slotted recess) at its other end and is fastened to the housing 2 of the internal combustion engine via a screw connection 29. With the tensioning lever 28, a drive belt 30, which runs via the driving wheel 26 of the driving shaft 36 and the drive wheel 27 of the fuel pump 5, can be tensioned in the conventional way and manner.

In FIG. 3, the fuel pump is shown enlarged. The drive wheel 27 exhibits a hub 32 and a belt contact surface 33. By means of this design, a revolving recess 34 is produced, into which recess a projecting part of the rotor pump case 11 extends, and thus the projecting outer side of the rotor pump case 11 and the inner side of the belt contact surface 32 of the drive wheel 27 lie so closely next to each other that contamination of the fuel pump with contaminant particles is prevented. The drive wheel 27 of the fuel pump 5 sits on a rotor pump shaft 9, said rotor pump shaft 9 being supported via a ball bearing 31 and a journal bearing 19. The ball bearing 31 is mounted in the rotor pump case 11 with a snap ring 37. In the rotor pump case 11, on the side away from the drive wheel 27, there is a pump space 12, which is occupied by an inner gear 13 and an outer gear 14. The inner gear 13 is on the rotor pump shaft 9 and is driven by the outer gear, which is rotatably supported in the rotor pump case 11. The pump space 12 is further provided with a fuel seal ring 20.

A suction port 17 for the fuel is mounted laterally on the rotor pump case 11, while the pressure port is not illustrated.

The rotor pump case 11 and simultaneously the pump space 12 are provided with a cover 15 and a seal 16, which can be removed for installation and maintenance via a screw connection 35.

FIG. 4 shows the belt drive 25 of an internal-combustion engine, which, starting from a driving wheel 26 that sits on the driving shaft 36, drives the camshaft 1 and is tensioned by the drive wheel 27 of the fuel pump 5.

The drive belt 30 of the belt drive 25 runs over the driving wheel 26 of the crankshaft, over the drive wheel 27 of the fuel pump 5, and over a drive wheel 38 of the camshaft 1. Via the tensioning lever 28, not shown in FIG. 4, the fuel pump 5 can be pivoted in order to increase or decrease the tension of the drive belt 30.

The rotor pump case 11 of the fuel pump 5 in FIG. 4 exhibits the suction port 17 as well as a pressure port 18.

The embodiment of the invention in which an exclusive property or privilege is claimed are defined as follows:

1. A fuel pump arrangement for an internal-combustion engine of the type having a camshaft (1), in which the fuel pump (5) is hydraulically connected between a mixture-forming means or an injecting means and a fuel tank, comprising a fuel pump (5) in the form of a rotor pump driven by and arranged in axial prolongation of said camshaft (1), said rotor pump including a rotor pump case (11) at one end of said camshaft (1) and having an internal pump space (12) at its axial side away from said one end of said camshaft (10, a fluid tight cover (15) closing said pump space (12), a journal bearing (19) in said rotor pump case (11), an inner gear (13) and an outer gear (14) disposed in said pump space (12), said outer gear (14) being driven by said inner gear (13), a central recess (7) in said camshaft (1), a rotor pump shaft (9) supported in said central recess (7) and said journal bearing (19) and a seal ring (20, 22) in sealing relation with and between said rotor pump shaft (9) and said rotor pump case (11), said seal ring (20, 22) surrounding said rotor pump shaft (9) at a location between said recess (7) and said journal bearing (19).

2. The fuel pump arrangement of claim 1 wherein said seal ring includes a fuel seal ring (20) and an oil seal ring (22), said fuel seal ring (20) being adjacent said pump space (12) and said oil seal ring (22) being adjacent said camshaft (1), said rings (20, 22) being axially spaced from one another defining an intermediate space (21) and further comprising a duct (23) in said rotor pump case (11) venting said intermediate space to the atmosphere.

3. In combustion with an internal-combustion engine of the type having a housing (2) and a crankshaft, a fuel pump (5) in the form of a rotor pump hydraulically connected between a mixture-forming means or an injecting means and a fuel tank, said rotor pump including a rotor pump case (11), an inner gear (13) and an outer gear (14) in said rotor pump case (11), said outer gear (14) being driven by said inner gear (13); a belt (25) interconnecting said rotor pump and said crankshaft, a tension lever (28) adjustably connected to said housing (2) of said internal-combustion engine and supporting said rotor pump case (11), whereby adjustment of said tension lever (28) relative to said housing (2) causes said rotor pump to act as an adjustable tensioning device for said belt (25).

4. The combination of claim 3 wherein said fuel pump includes a drive shaft (9), a drive pulley having a hub (32) coaxially secured in driving relation to said drive shaft (9) and a drive wheel (27) in driven relation to said belt (25) and presenting an annular recess (34) between said hub (32) and said drive wheel (27), and wherein said rotor pump case (11) includes an axially projecting part extending into said annular recess (34).

5. In combination with an internal combustion engine having a housing and a crankshaft, the combination comprising: a rotor fuel pump including a rotor pump case (11) mounted on said housing and presenting a pump space (12), a pair of axially spaced bearings (19, 31) in said pump case (11), an inner gear (13) and an outer gear (14) in said pump space (12), said outer gear (14) being driven by an inner gear (13), a fluid tight cover (15) releasably secured to the rotor pump case (11) and closing said pump space (12), a rotor pump shaft (9) supported by said bearings (19, 21) and having one end extending into said pump space (12) where it is connected to said inner gear (13), a drive pulley having a drive wheel (27) and a hub (32) coaxially-secured to the other end of said drive shaft, a drive belt (30) drivingly interconnected said crankshaft with said drive wheel (27), said drive pulley presenting an annular recess (34) between said hub (32) and drive wheel (27), said rotor pump case (11) having an axially projecting part extending into said annular recess.

6. The combination of claim 5 wherein one of said bearings is supported on said axially projecting part of said rotor pump case (11) and lies in the plane of the drive wheel (27).

* * * * *

UNITED STATES PATENT AND TRADEMARK OFFICE

CERTIFICATE OF CORRECTION

PATENT NO. : 5,188,072

DATED : Feb. 23, 1993

INVENTOR(S) : Albert Nolte, Joachim Altdorf, Paul Scheffler

It is certified that error appears in the above-identified patent and that said Letters Patent is hereby corrected as shown below:

Column 2, line 50, after "would" insert --- be ---;

Column 4, line 23, after "point" insert --- between ---;

Column 5, 38, cancel "(10" and substitute --- (1) ---;

Column 6, line 6, cancel "combustion" (first occurrence) and substitute --combination --.

Signed and Sealed this

Seventh Day of December, 1993

*Attest:*

Bruce Lehman

BRUCE LEHMAN

*Attesting Officer*

*Commissioner of Patents and Trademarks*